US012263417B2

(12) United States Patent
Kamiyama

(10) Patent No.: US 12,263,417 B2
(45) Date of Patent: Apr. 1, 2025

(54) MODEL TOY AND COOKING TOY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 197 days.

(21) Appl. No.: 17/992,171

(22) Filed: Nov. 22, 2022

(65) Prior Publication Data

US 2023/0158421 A1 May 25, 2023

(30) Foreign Application Priority Data

Nov. 24, 2021 (JP) ..... 2021-190276

(51) Int. Cl.
*A63H 33/42* (2006.01)
*A63H 33/30* (2006.01)

(52) U.S. Cl.
CPC ..... *A63H 33/3055* (2013.01)

(58) Field of Classification Search
CPC ..... A63H 33/3055
See application file for complete search history.

(56) References Cited

U.S. PATENT DOCUMENTS 1,565,209 A * 12/1925 Schwarzenhauer ..... F24C 7/00 219/404
1,960,868 A * 5/1934 De Boer ..... A24F 19/06 296/37.9
2,159,062 A * 5/1939 Visser ..... B60N 3/083 296/37.9
2,174,244 A * 9/1939 Jacobs ..... B60N 3/083 296/37.9
2,196,648 A * 4/1940 Visser ..... A24F 19/06 16/259
2,294,173 A * 8/1942 Gillisse ..... B60N 3/083 296/37.9
2,505,324 A * 4/1950 Hendricks ..... B60N 3/083 296/37.9
2,771,209 A * 11/1956 Flynn ..... A24F 19/06 296/37.9
2,771,885 A * 11/1956 Walker ..... A24F 19/00 296/37.9
2,973,766 A * 3/1961 Milbourne ..... A24F 19/14 296/37.9
3,453,034 A * 7/1969 De Boer ..... B60N 3/083 296/37.9

(Continued)

FOREIGN PATENT DOCUMENTS

JP 2018-164492 A 10/2018

*Primary Examiner* — Eugene L Kim
*Assistant Examiner* — Matthew B Stanczak
(74) *Attorney, Agent, or Firm* — Faegre Drinker Biddle & Reath LLP

(57) ABSTRACT

A model toy includes: a main body portion; and a tray including a placement surface, the tray being stored inside the main body portion and configured to be drawn out from the main body portion. The main body portion includes a standing wall portion extending along a draw-out direction of the tray from an inner side of the main body portion to a position on or above the placement surface. The standing wall portion has a cutout portion that is cut out in an arc shape to face a draw-out side of the tray.

9 Claims, 7 Drawing Sheets

(56) References Cited

U.S. PATENT DOCUMENTS

| | | | | | |
|---|---|---|---|---|---|
| 3,787,987 | A * | 1/1974 | Brass | G09B 17/00 | 434/258 |
| 3,949,658 | A * | 4/1976 | Morrison | A63H 33/3055 | 99/341 |
| 4,515,359 | A * | 5/1985 | Mariol | A63H 3/52 | 446/481 |
| 4,604,076 | A * | 8/1986 | St. Pierre | A63H 33/3055 | 446/481 |
| 4,772,243 | A * | 9/1988 | Zeiss | A63H 33/3055 | 446/481 |
| 5,160,288 | A * | 11/1992 | Seda | A63H 33/30 | 446/236 |
| 5,346,423 | A * | 9/1994 | Caveza | A63H 33/3055 | 426/104 |
| 5,716,253 | A * | 2/1998 | Aoki | A63H 33/22 | 446/481 |
| 5,954,561 | A * | 9/1999 | Cannone | A63H 33/3055 | 446/481 |
| 6,048,251 | A * | 4/2000 | Klitsner | A63H 33/003 | 446/76 |
| 8,568,193 | B1 * | 10/2013 | Evans | A63H 33/3055 | 446/168 |
| 11,179,651 | B2 * | 11/2021 | Kamiyama | A63H 33/3055 | |
| 11,478,722 | B2 * | 10/2022 | Kamiyama | A63H 33/3055 | |
| 2017/0173489 | A1 * | 6/2017 | Akavia | A63H 33/3055 | |
| 2017/0197155 | A1 * | 7/2017 | Su | A63H 33/42 | |
| 2023/0158421 | A1 * | 5/2023 | Kamiyama | A63H 33/3055 | 446/481 |

* cited by examiner

MODEL TOY AND COOKING TOY

CROSS-REFERENCE TO RELATED APPLICATIONS

This application is based on and claims priority under 35 USC 119 from Japanese Patent Application No. 2021-190276 filed on Nov. 24, 2021, the contents of which are incorporated herein by reference.

TECHNICAL FIELD

The present disclosure relates to a model toy and a cooking toy.

BACKGROUND ART

In the related art, model toys imitating kitchen products have been provided. For example, JP2018-164492A discloses, as a kind of toy sets, a simulated oven into which an intermediate material obtained by mixing a base material and an expanding agent can be introduced. When the intermediate material prepared as a dough of a simulated bread is introduced into the simulated oven, the intermediate material swells to a thickness of about 1.2 times after 20 minutes. Then, an oiliness agent is applied to the simulated bread after drying, whereby the simulated bread is colored to imitate seizing.

SUMMARY OF INVENTION

However, in the model toy of JP2018-164492A described above, it takes time from the introduction of the simulated bread to acquisition of the simulated bread after cooking. Consequently, a user cannot enjoy a play of simulating a state change before and after the cooking in an easy way.

An object of the present invention is to provide a model toy and a cooking toy with which a user can enjoy a play of simulating a state change before and after cooking in an easy way.

The present disclosure provides a model toy including: a main body portion; and a tray including a placement surface, the tray being stored inside the main body portion and configured to be drawn out from the main body portion, wherein the main body portion includes a standing wall portion extending along a draw-out direction of the tray from an inner side of the main body portion to a position on or above the placement surface, and wherein the standing wall portion has a cutout portion that is cut out in an arc shape to face a draw-out side of the tray.

The present disclosure provides a cooking toy including: a main body portion; a tray including a placement surface, the tray being stored inside the main body portion and configured to be drawn out from the main body portion; and a figure body having a front surface and a back surface, the figure body being configured to be placed on the placement surface in an invertible manner, wherein the main body portion includes a standing wall portion extending along a draw-out direction of the tray from an inner side of the main body portion to a position on or above the placement surface, and wherein the standing wall portion has a cutout portion that is cut out in an arc shape to face a draw-out side of the tray.

According to the present disclosure, a model toy and a cooking toy with which a user can enjoy a play of simulating a state change before and after cooking in an easy way.

BRIEF DESCRIPTION OF DRAWINGS

FIG. 6A shows a state before the pie dough model on the tray starts to be inverted, and FIG. 6B shows a state after the pie dough model on the tray starts to be inverted.

FIG. 7A shows a state in which the pie dough model on the tray is being reversed, and FIG. 7B shows a state in which the pie dough model on the tray is completely reversed.

DESCRIPTION OF EMBODIMENTS

Figure 1:
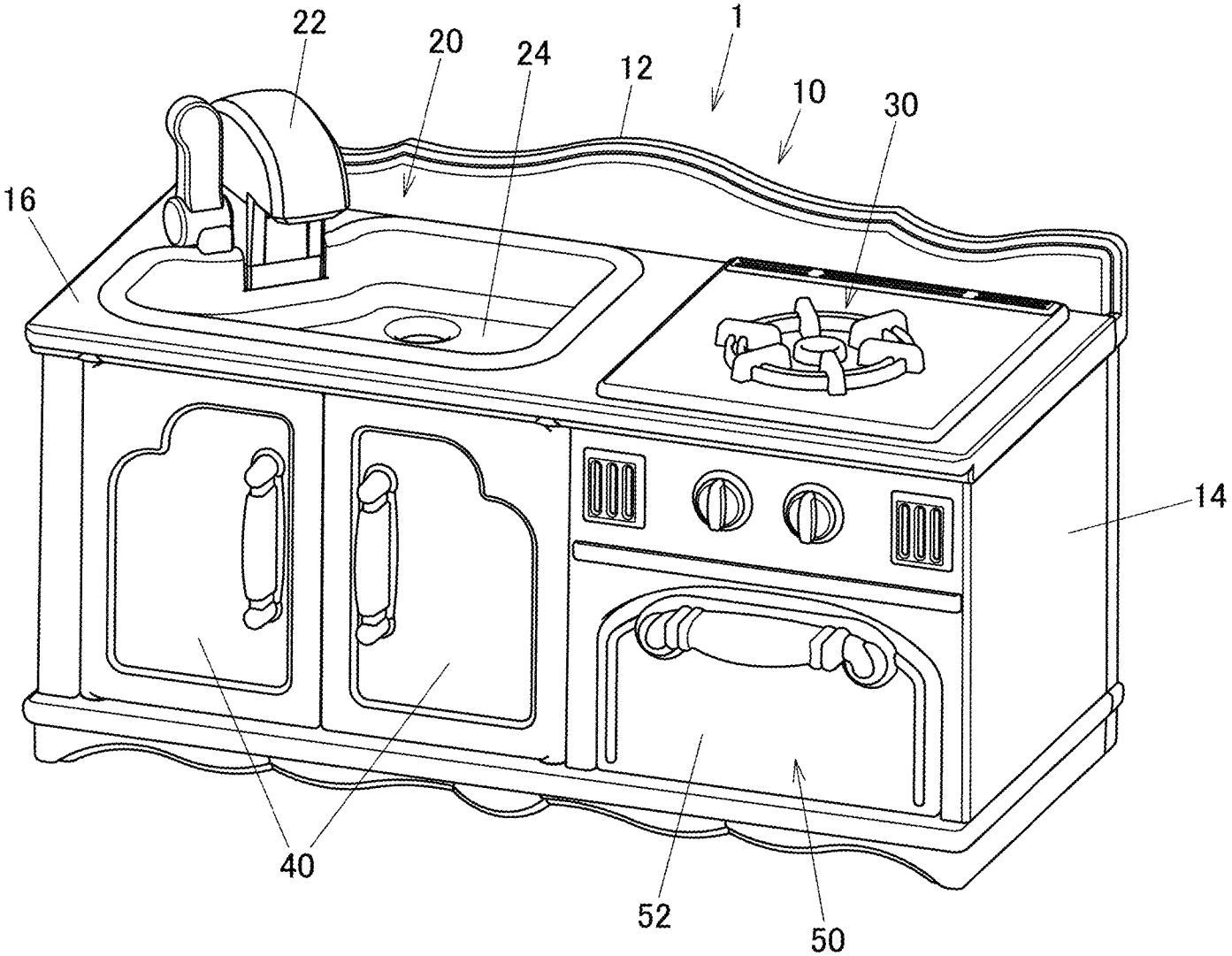
FIG. 1 is an overall perspective view of a kitchen toy according to an embodiment.

An embodiment of the present disclosure will be described with reference to the drawings. As shown in FIG. 1, in the embodiment, a kitchen toy (model toy, cooking toy) 1 imitating a kitchen will be exemplified. The kitchen toy 1 is a toy with which a user can use a figurine or the like to play house. The kitchen toy 1 is formed in a substantially rectangular parallelepiped shape that is horizontally long as a whole, and includes a main body portion 10 in which a washstand 20 and a stove 30 are provided at an upper portion thereof. A door portion 40 is provided on a lower side of the washstand 20. An oven 50 including a tray 52 that is stored inside the main body portion 10 to be freely drawn out is provided on a lower side of the stove 30.

In the kitchen toy 1, when the tray 52 on which an object is placed is pushed into the oven 50, the object on the tray 52 is reversed inside the main body portion 10. The kitchen toy 1 is, for example, a toy in which a food model in which decoration before heat cooking is applied to a front surface and decoration after the heat cooking is applied to the back surface is placed on the tray 52 with a front surface side thereof facing upward, the tray 52 is pushed into an oven 50, and then the tray 52 is drawn out such that a back surface side of the food model faces upward, thereby allowing the user to enjoy cooking imitation. In the following description, a door portion 40 side of the kitchen toy 1 is referred to as a front side, an opposite side is referred to as a rear side, an oven 50 side viewed from a front side of the kitchen toy 1 is referred to as a right side, and an opposite side is referred to as a left side.

In the main body portion 10, a rear wall portion (perpendicular wall portion) 12 constituting a rear surface, an outer wall portion 14 constituting a front surface, left and right side surfaces, and a lower surface, and a top plate portion (parallel wall portion) 16 constituting an upper surface are integrally provided, and an inside of the main body portion 10 is hollow. The door portion 40 provided on a front surface side of the outer wall portion 14 is a double-openable hinged door. A faucet 22 and a sink 24 are disposed on the washstand 20 provided on a left side of a top plate portion 16. A water distribution pipe 26 is provided on a rear wall portion 12 at a position inside the main body portion 10 and on a lower side of the sink 24, and the water distribution pipe 26 is formed to imitate a state of communicating with a drain groove portion of the sink 24 (see FIG. 4).

Figure 2:
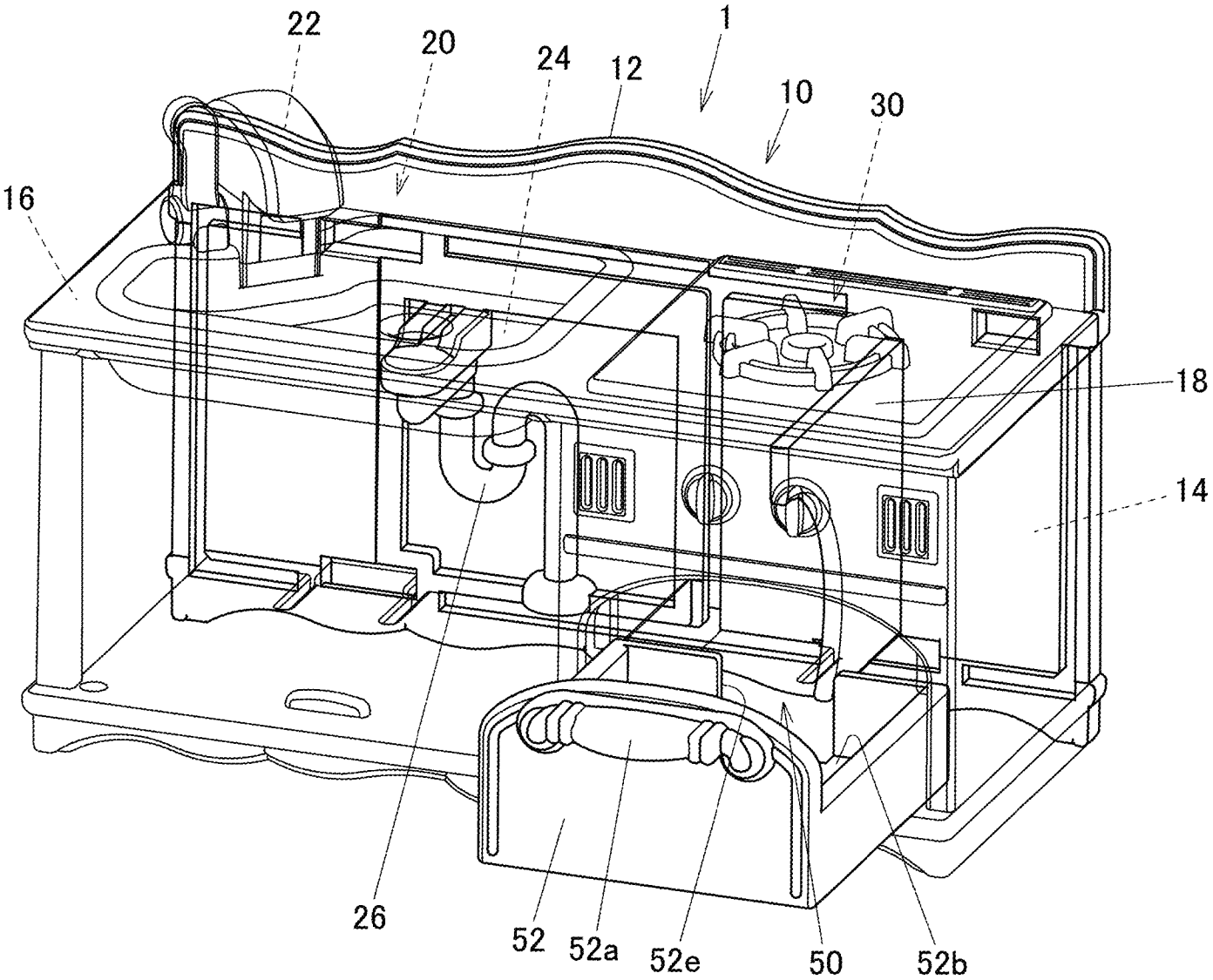
FIG. 2 is a perspective view of the kitchen toy according to the embodiment in a state in which a door portion is removed, an outer wall portion is transparent, and a tray is drawn out.
Figure 3:
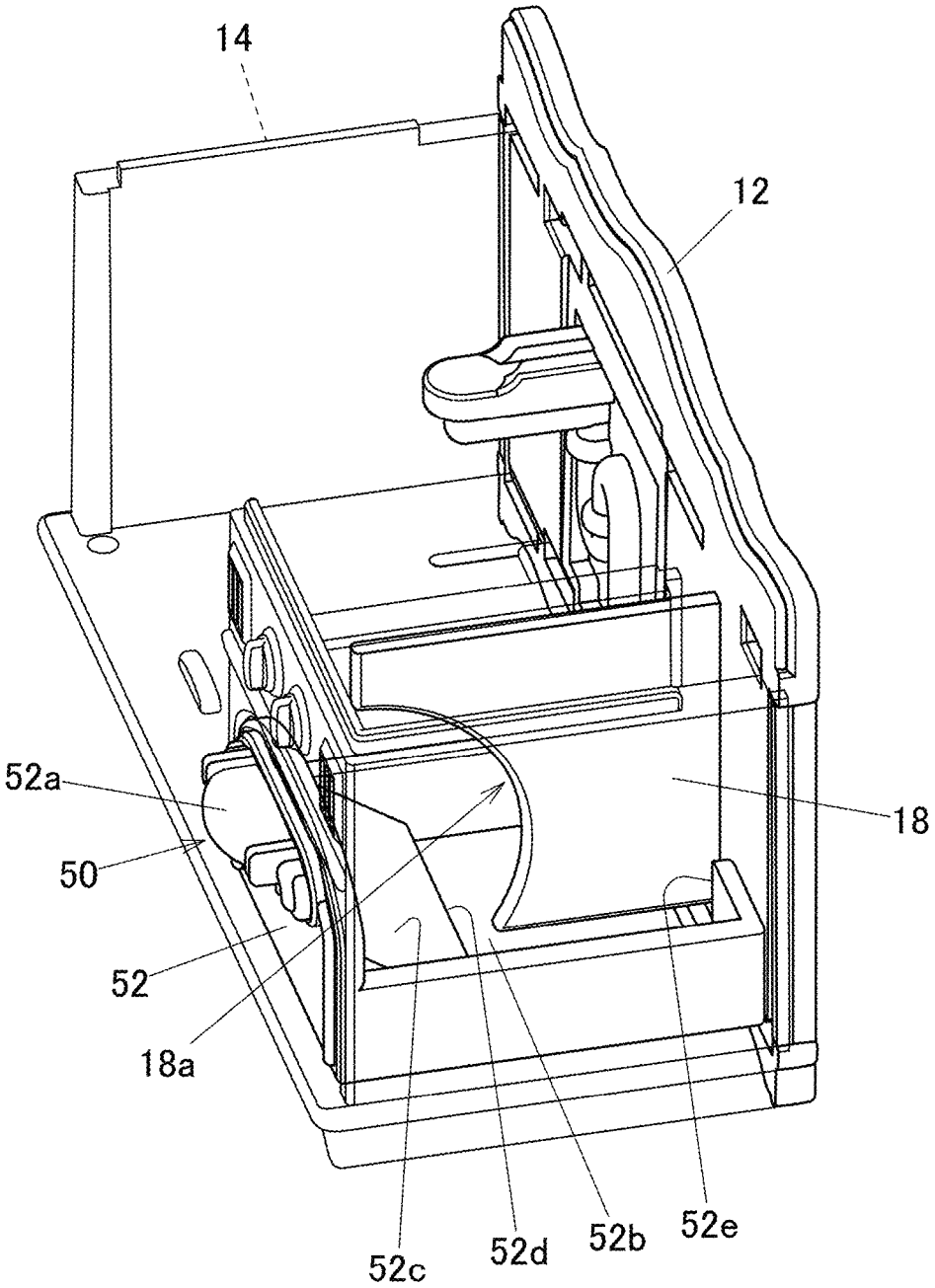
FIG. 3 is a perspective view of the kitchen toy according to the embodiment in a state in which the door portion and a top plate portion are removed and the outer wall portion is transparent.

The tray 52 provided in the oven 50 can be drawn out forward and stored inside the main body portion 10 (see FIG. 2). As shown in FIGS. 2 and 3, the tray 52 is formed in a substantial box shape having a handle portion 52*a* on the front side and opening upward, and has a rectangular placement surface 52*b* on which a figure body to be described later is placed. The placement surface 52*b* is perpendicular to a wall surface of the rear wall portion 12 and parallel to a plate surface of the top plate portion 16. As used herein, the terms "perpendicular" and "parallel" may include "substantially perpendicular" and "substantially parallel", respectively. An inclined surface 52*c* that is inclined upward from the placement surface 52*b* toward a handle portion 52*a* side is provided on the front side of the placement surface 52*b*. A slight step 52*d* is provided between the placement surface 52*b* and the inclined surface 52*c* (see FIG. 3 and FIGS. 6A and 6B). Further, a recessed opening 52*e* in which a substantially central portion in a left-right direction is cut out in a recessed shape to open is formed in a rear wall surface of the tray 52.

As shown in FIG. 3, inside the main body portion 10, a standing wall portion 18 extending from the rear wall portion 12 such that a wall surface thereof extends along a front-rear direction (a draw-out direction of the tray 52) is provided. A wall surface of the standing wall portion 18 is perpendicular to the placement surface 52*b* of the tray 52, and the standing wall portion 18 extends from the rear wall portion 12 onto the placement surface 52*b* through the recessed opening 52*e* of the tray 52. As used herein, the term "perpendicular" may include "substantially perpendicular". Further, the standing wall portion 18 is provided to be positioned at a substantially central portion in the left-right direction on the placement surface 52*b*. The placement surface 52*b* and the standing wall portion 18 may be close to each other, or may be brought into sliding contact with each other such that the tray 52 can be freely drawn out forward.

A cutout portion 18*a* cut out in an arc shape is formed on a distal side of the standing wall portion 18. The cutout portion 18*a* is provided to face the front side, that is, a draw-out side of the tray 52, from a position of the standing wall portion 18 close to the inclined surface 52*c* on the placement surface 52*b* to a position close to an upper portion of the front side of the standing wall portion 18. Since the cutout portion 18*a* is provided in this manner, the inclined surface 52*c* of the tray 52 faces the cutout portion 18*a*.

Figure 4:
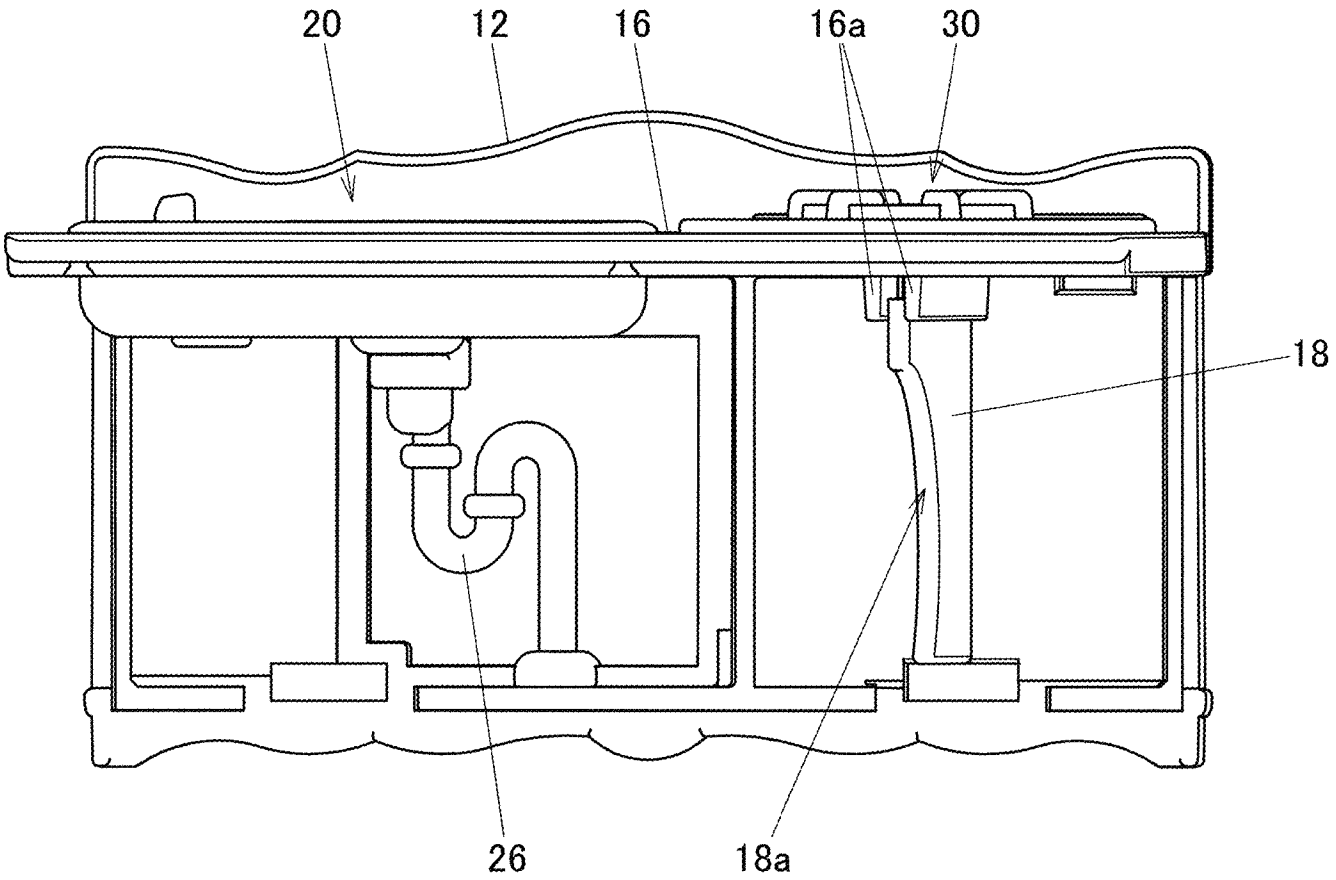
FIG. 4 is a perspective view showing a rear wall portion and the top plate portion of the kitchen toy according to the embodiment.

As shown in FIG. 4, a pair of sandwiching wall portions (holding portions) 16*a* extending from the top plate portion 16 is provided inside the main body portion 10 to sandwich an upper end portion of the standing wall portion 18 in the left-right direction. An upper portion of the standing wall portion 18 is held in the left-right direction by the pair of holding wall portions 16*a*. Accordingly, the standing wall portion 18 is more likely to be bent in the left-right direction than in a case where the standing wall portion 18 is fixed to the top plate portion 16.

Figure 5A:
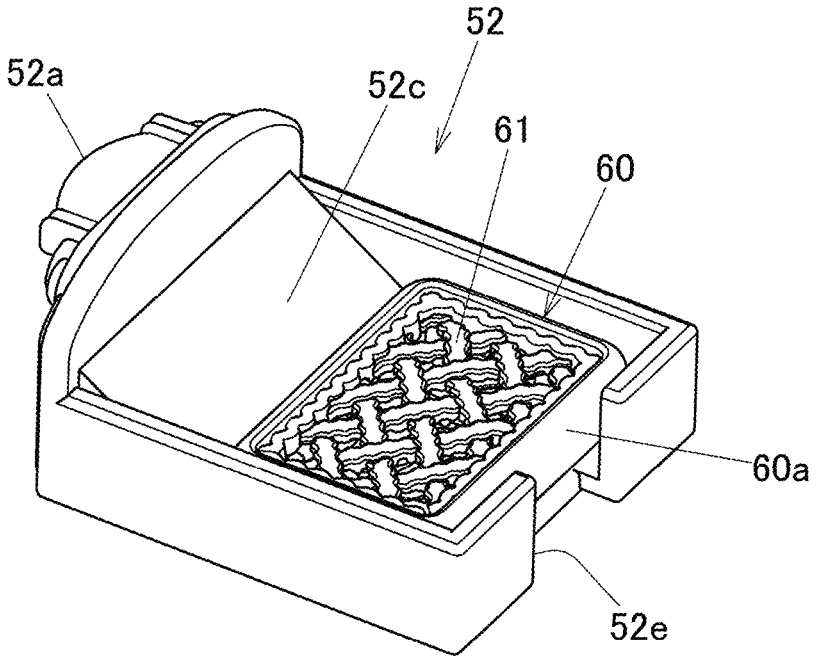
FIG. 5A is a perspective view of the tray on which a pie dough model is placed with a state before heat cooking facing upward.

Next, the figure body placed on the placement surface 52*b* of the tray 52 will be described. In the present embodiment, as an example of the figure body having a front surface and a back surface, a pie dough model 60 imitating a pie dough is shown. As shown in FIG. 5A, the pie dough model 60 has a flat plate shape along the placement surface 52*b*, a dimension in the front-rear direction and a dimension in the left-right direction thereof are substantially the same as those of the placement surface 52*b*, and the pie dough model 60 has a thickness that allows the pie dough model 60 to be stored in the tray 52. The pie dough model 60 is stored in the tray 52 in an invertible manner in a state of being close to or in contact with the step 52*d* on the tray 52.

Figure 5B:
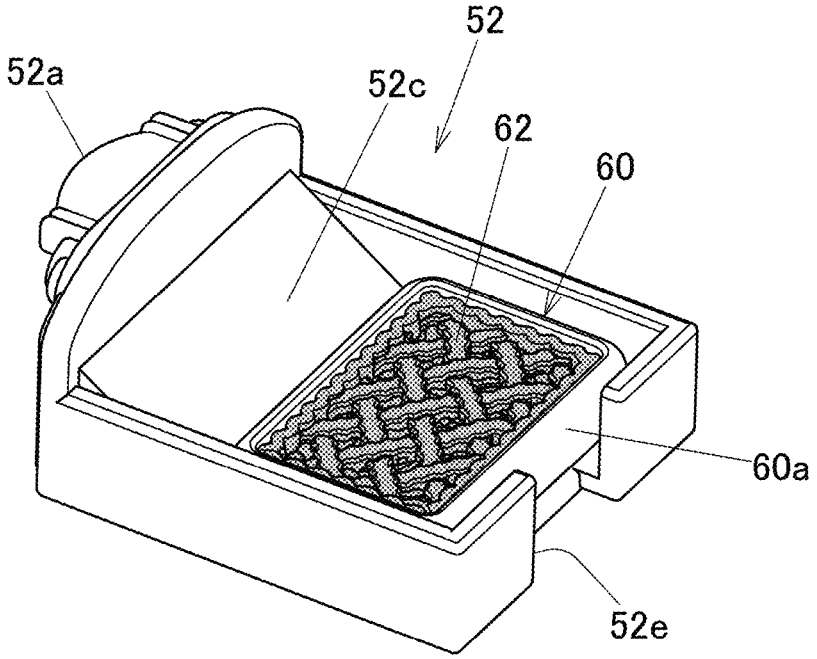
FIG. 5B is a perspective view of the tray on which the pie dough model is placed with a state after the heat cooking facing upward.

An end edge 60*a* of the front surface and the back surface of the pie dough model 60 is formed in a rounded shape. A portion surrounded by the rounded end edge 60*a* of the pie dough model 60 is slightly recessed in both the front surface and the back surface. Of the recessed portions of the pie dough model 60, a decoration 61 (hereinafter, referred to as "pre-cooking decoration") imitating the pie dough before the heat cooking is applied to the front surface (see FIG. 5A), and a decoration 62 (hereinafter, referred to as "post-cooking decoration") imitating the pie dough after the heat cooking is applied to the back surface (see FIG. 5B).

Figure 6A:
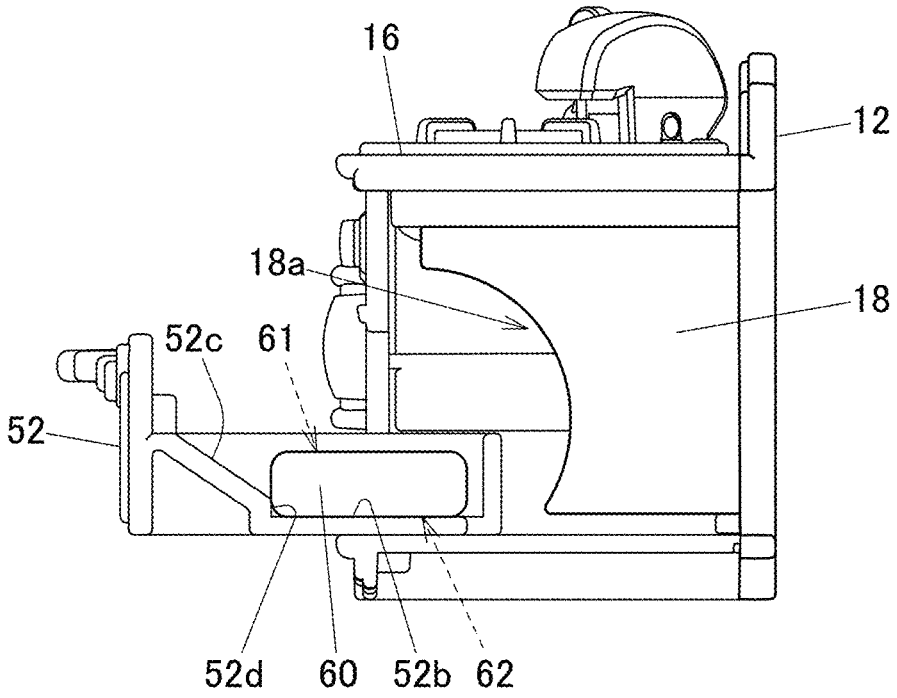
FIGS. 6A and 6B are transparent side views showing an operation of the kitchen toy according to the embodiment.

Next, a description will be given of an operation in which the tray 52 on which the pie dough model 60 is placed is pushed into the oven 50 to reverse the pie dough model 60 on the tray 52 inside the main body portion 10 in the kitchen toy 1. FIG. 6A shows a partially transparent side view of a state in which the pie dough model 60 is placed on the placement surface 52*b* of the tray 52 pulled out to a front side of the oven 50 with the front surface to which the pre-cooking decoration 61 is applied as an upper side. In the state of FIG. 6A, the pie dough model 60 on the placement surface 52*b* is separated from the cutout portion 18*a* of the standing wall portion 18.

Figure 6B:
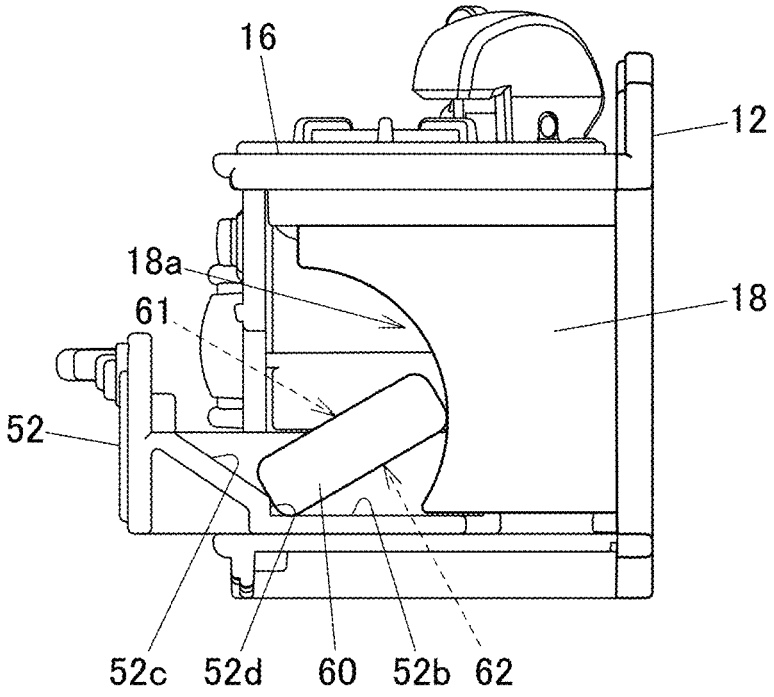

When the tray 52 is pushed in from the state shown in FIG. 6A, first, the pie dough model 60 on the placement surface 52*b* comes into contact with a lower end portion of the cutout portion 18*a* and is pushed toward a cutout portion 18*a* side by the step 52*d* to ride on the cutout portion 18*a* (a state shown in FIG. 6B). Accordingly, the reversing of the pie dough model 60 is started. At this time, since the end edge 60*a* of the pie dough model 60 is rounded, the pie dough model 60 is prevented from being caught by a front lower end portion of the standing wall portion 18, and the pie dough model 60 smoothly rides on the cutout portion 18*a*.

Figure 7A:
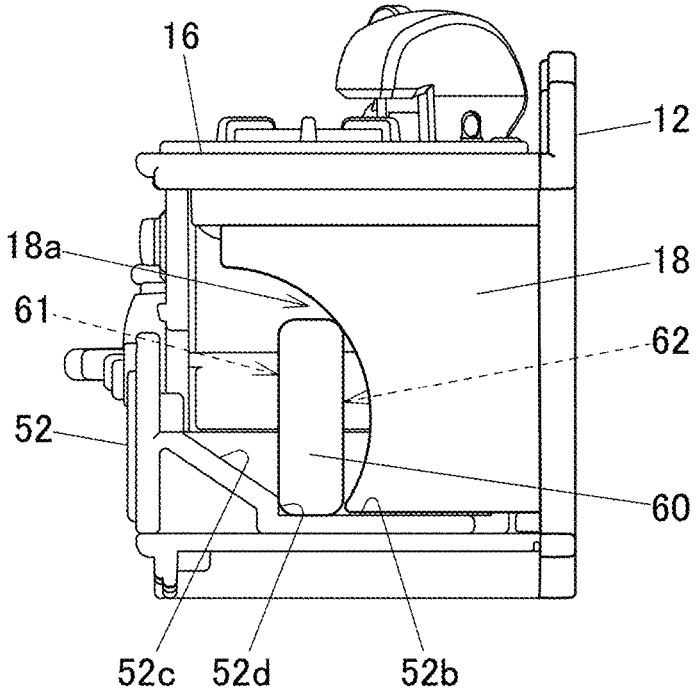
FIGS. 7A and 7B are transparent side views showing the operation of the kitchen toy according to the embodiment.

Thereafter, the pie dough model 60 ridden on the cutout portion 18*a* is further pushed by the step 52*d* to rise along the cutout portion 18*a*, and becomes in an upright state on the placement surface 52*b* between the step 52*d* and the cutout portion 18*a* (a state shown in FIG. 7A). At this time, since the standing wall portion 18 bends in the left-right direction, stress applied from the standing wall portion 18 to the pie dough model 60 pressed by the step 52*d* is alleviated, and the pie dough model 60 smoothly rises along the cutout portion 18*a*.

Figure 7B:
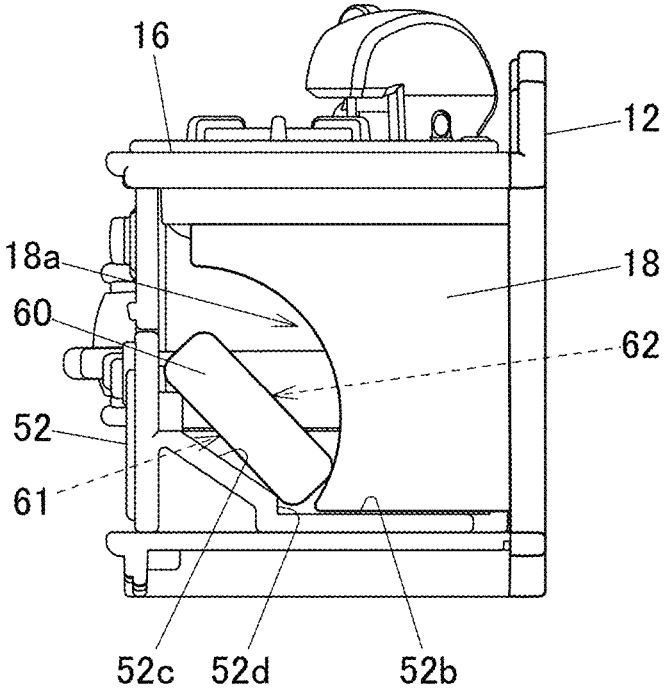

Thereafter, the pie dough model 60 in the upright state is inverted by being pushed by a rising reaction and the step 52*d*, and falls toward an inclined surface 52*c* side. Accordingly, a lower end of the pie dough model 60 rides on the lower end portion of the cutout portion 18*a* and is supported in a state of being inclined toward the inclined surface 52*c* side (a state shown in FIG. 7B). When the tray 52 is drawn out forward in this state, the inverted pie dough model 60 is separated from the standing wall portion 18, is released from being supported by the standing wall portion 18, falls on the inclined surface 52*c*, and is guided onto the placement surface 52*b* by the inclined surface 52*c*. As a result, the tray 52 on which the pie dough model 60 with the back surface on which the post-cooking decoration 62 is applied facing upward is placed on the placement surface 52*b* can be drawn out from the oven 50.

As described above, in the kitchen toy according to the present embodiment, by pushing the tray 52 on which the pie dough model 60 is placed on the placement surface 52*b* into the oven 50, the pie dough model 60 is reversed inside the main body portion 10. Thereafter, by drawing the tray 52 out from the oven 50, the inverted pie dough model 60 appears on the tray 52. Therefore, by using the pie dough model 60 in which the decoration before and after the heating cooking is applied to the front surface and the back surface, respectively, as the figure body placed on the placement surface 52*b*, the user can enjoy the play of simulating the state change of the pie dough model 60 before and after the heating cooking in an easy way.

According to the embodiment of the present disclosure as described above, a model toy and a cooking toy in the following aspects can be provided.

The model toy according to a first aspect includes a main body portion, and a tray that has a placement surface, the tray being stored inside the main body and configured to be drawn out from the main body portion. The main body portion includes a standing wall portion extending along a draw-out direction of the tray from an inner side of the main body portion to a position on or above the placement surface, and the standing wall portion has a cutout portion that is cut out in an arc shape to face a draw-out side of the tray.

According to this configuration, a flat plate-shaped figure body is placed on the placement surface of the tray, and the tray is pushed into the main body portion, whereby the figure body comes into contact with the cutout portion on the placement surface and rides on the cutout portion, and rises along the cutout portion and is inverted. Therefore, for example, by placing the figure body in which the decoration before and after cooking is applied to a front surface and a back surface thereof, respectively, on the placement surface of the tray, pushing the tray into the main body portion, and then drawing out the tray, the user can enjoy the play of simulating the state change before and after cooking in an easy way.

In the model toy according to a second aspect, the tray has the placement surface provided along the draw-out direction of the tray and an inclined surface provided to be inclined from the placement surface to face the cutout portion.

According to this configuration, since the figure body which rises along the cutout portion inside the main body portion and is inverted falls to the inclined surface side and rides on the inclined surface, the figure body is guided from the inclined surface to the placement surface by drawing out the tray. Therefore, it is possible to improve an appearance when the tray in which the inverted figure body is placed on the placement surface is drawn out.

In a model toy according to a third aspect, a step is provided between the placement surface and the inclined surface.

According to this configuration, it is possible to easily invert the figure body by the step when the tray is pushed into the main body portion.

In a model toy according to a fourth aspect, the main body portion includes an perpendicular wall portion provided to be perpendicular to the placement surface of the tray, and a parallel wall portion provided to be parallel to the placement surface of the tray. The standing wall portion extends from the perpendicular wall portion, and the parallel wall portion includes a holding portion configured to sandwich and hold a part of the standing wall portion.

According to this configuration, the standing wall portion is more likely to be bent in a sandwiching direction of the holding portions than in a case where the standing wall portion is fixed to the top plate portion. Therefore, when the figure body on the placement surface rises along the cutout portion, the standing wall portion is bent in the sandwiching direction of the holding portions, stress received by the figure body from the standing wall portion is alleviated, and the figure body smoothly rises along the cutout portion. Therefore, the figure body on the placement surface can be easily inverted by the cutout portion.

In a model toy according to a fifth aspect, the tray includes a wall surface provided on a rear side of the tray, the wall surface having a recessed opening that is cut out in a recessed shape to open at a position corresponding to the standing wall.

According to this configuration, it is possible to hold the figure body at the wall surface and guide the standing wall in the tray through the recessed opening.

A cooking toy according to a first aspect includes a main body portion, a tray that has a placement surface, the tray being stored inside the main body and configured to be drawn out from the main body portion, and a figure body having a front surface and a back surface, the figure body being configured to be placed on the placement surface in an invertible manner. The main body portion includes a standing wall portion extending along a draw-out direction of the tray from an inner side of the main body portion to a position on or above the placement surface, and the standing wall portion has a cutout portion that is cut out in an arc shape to face a draw-out side of the tray.

According to this configuration, by pushing the tray in which the figure body is placed on the placement surface into the main body portion, the figure body comes into contact with the cutout portion on the placement surface and rides on the cutout portion, and rises along the cutout portion and is inverted. Therefore, by placing the figure body whose decorations indicating cooking states are different before and after the inversion on the placement surface of the tray, pushing the tray into the main body portion, and then drawing out the tray, the user can enjoy the play of simulating the state change before and after the cooking in an easy way.

In a cooking toy according to a second aspect, the placement surface has a rectangular shape, and the figure body is formed in a flat plate shape along the placement surface, and an end edge of the figure body is formed to be rounded.

According to this configuration, the figure body is stored in the tray. Then, when the figure body rides on the cutout portion, the figure body is prevented from being caught by a part of the standing wall portion, and smoothly rides on the cutout portion. Therefore, the figure body can ride on the cutout portion in an easy way. As a result, the figure body can be inverted by the cutout portion in an easy way.

In a cooking toy according to a third aspect, the figure body is a food model in which decoration before heat cooking is applied to the front surface and decoration after the heat cooking is applied to the back surface.

According to this configuration, the user can enjoy the play of simulating the state change before the heat cooking and after the heat cooking.

Although the embodiment of the present disclosure has been described above, the present disclosure is not limited to the above-described embodiment, and various modifications can be made without departing from the scope of the appended claims. For example, in the embodiment described above, the pie dough model is exemplified as the figure body, but the figure body is not limited thereto, and various figure bodies imitating food can be used. In addition, in the above-described embodiment, a configuration in which one standing wall portion is provided in the main body portion is exemplified, but a configuration in which a plurality of standing wall portions each having the cutout portion are provided in the main body portion over the left-right direction may be adopted.

What is claimed is:

1. A model toy comprising:

a main body portion; and a tray comprising a placement surface, the tray being stored inside the main body portion and configured to be drawn out from the main body portion, wherein the main body portion comprises i) a standing wall portion extending along a draw-out direction of the tray from an inner side of the main body portion to a position on or above the placement surface, ii) a perpendicular wall portion provided to be perpendicular to the placement surface of the tray, iii) an outer wall portion including a left side surface and a right side surface, the left side surface and the right side surface are perpendicular to the placement surface of the tray, and iv) a parallel wall portion provided to be parallel to the placement surface of the tray, wherein the standing wall portion has a cutout portion that is cut out in an arc shape to face a draw-out side of the tray, and wherein the standing wall portion extends from the perpendicular wall portion and between the left side surface of the outer wall portion and the right side surface the outer wall portion.

2. The model toy according to claim 1, wherein the tray has the placement surface provided along the draw-out direction of the tray and an inclined surface provided to be inclined from the placement surface to face the cutout portion.

3. The model toy according to claim 2, wherein a step is provided between the placement surface and the inclined surface.

4. The model toy according to claim 1, wherein the parallel wall portion comprises a holding portion configured to sandwich and hold a part of the standing wall portion.

5. The model toy according to claim 1, wherein the tray comprises a wall surface provided on a rear side of the tray, the wall surface having a recessed opening that is cut out in a recessed shape to open at a position corresponding to the standing wall.

6. A cooking toy comprising:

a main body portion;

a tray comprising a placement surface, the tray being stored inside the main body portion and configured to be drawn out from the main body portion; and a figure body having a front surface and a back surface, the figure body being configured to be placed on the placement surface in an invertible manner, wherein the main body portion comprises i) a standing wall portion extending along a draw-out direction of the tray from an inner side of the main body portion to a position on or above the placement surface, ii) a perpendicular wall portion provided to be perpendicular to the placement surface of the tray, iii) an outer wall portion including a left side surface and a right side surface, the left side surface and the right side surface are perpendicular to the placement surface of the tray, and iv) a parallel wall portion provided to be parallel to the placement surface of the tray, wherein the standing wall portion has a cutout portion that is cut out in an arc shape to face a draw-out side of the tray, and wherein the standing wall portion extends from the perpendicular wall portion and between the left side surface of the outer wall portion and the right side surface the outer wall portion.

7. The cooking toy according to claim 6, wherein the placement surface has a rectangular shape, and wherein the figure body is formed in a flat plate shape along the placement surface, and an end edge of the figure body is formed to be rounded.

8. The cooking toy according to claim 6, wherein the figure body is a food model in which a decoration depicting the food uncooked is located on the front surface of the figure body and a decoration depicting the food cooked is located on the back surface of the figure body.

9. A cooking toy comprising:

a main body portion;

a tray comprising a placement surface, the tray being stored inside the main body portion and configured to be drawn out from the main body portion; and a figure body having a front surface and a back surface, the figure body being configured to be placed on the placement surface in an invertible manner, wherein the main body portion comprises a standing wall portion extending along a draw-out direction of the tray from an inner side of the main body portion to a position on or above the placement surface, wherein the standing wall portion has a cutout portion that is cut out in an arc shape to face a draw-out side of the tray, and wherein the figure body is a food model in which a decoration depicting the food uncooked is located on the front surface of the figure body and a decoration depicting the food cooked is located on the back surface of the figure body.

* * * * *